US005156375A

United States Patent [19]

Liegel et al.

[11] Patent Number: 5,156,375

[45] Date of Patent: Oct. 20, 1992

[54] LOAD CARRYING ADAPTOR FOR A TRANSMISSION JACK

[75] Inventors: Reinald D. Liegel; James G. Ballard, both of Waukesha, Wis.

[73] Assignee: Hein-Werner Corporation, Waukesha, Wis.

[21] Appl. No.: 659,982

[22] Filed: Feb. 22, 1991

[51] Int. Cl.[5] ..... B66F 3/00

[52] U.S. Cl. ..... 254/134; 254/DIG. 16

[58] Field of Search ..... 254/133, 134, DIG. 16, 254/8 B; 269/17, 296

[56] References Cited

U.S. PATENT DOCUMENTS

| | | | |
|---|---|---|---|
| 1,135,481 | 4/1915 | Zieve | 269/242 |
| 1,157,120 | 10/1915 | Myhre | 269/242 |
| 3,040,908 | 6/1962 | Johnson | 254/134 |
| 3,062,500 | 11/1962 | Arnes et al. | 254/134 |
| 3,559,981 | 3/1968 | Abshear | 254/134 |
| 4,269,394 | 5/1981 | Gray | 254/134 |

*Primary Examiner*—Robert C. Watson

*Attorney, Agent, or Firm*—Foley & Lardner

[57] ABSTRACT

An adaptor for transmission jack of the type having an adjustable platform on the upper end of the jack, the adaptor including a centering block mounted on the platform, an inner and outer plate assembly mounted on the platform on each side of the centering block, the plate assemblies being simultaneously movable toward and away from the centering block, a fixture support bar mounted on each of the plate assemblies and a pair of fixture assemblies movably mounted on each of the support bars, fixture assemblies being separately movable to support and align the longitudinal axis of a transmission on the platform and the inner and outer plate assemblies being longitudinally movable to increase or decrease the distance between the fixture assemblies to accommodate the different length transmissions.

7 Claims, 4 Drawing Sheets

LOAD CARRYING ADAPTOR FOR A TRANSMISSION JACK

FIELD OF THE INVENTION

The present invention relates to a high rise lifting jack of the type used for repair and replacement of automobile transmissions and the like and more particularly to an adaptor which can be readily affixed to the tilt platform of the jack to center and stabilize the transmissions with respect to the jack.

BACKGROUND OF THE INVENTION

Jacks of the type contemplated herein are used for the repair or replacement of automobile, truck or similar vehicle transmissions. The jack must have the capability of both raising and lowering the transmission for repair and replacement. Because of the various sizes and shapes of the transmissions, adjustments have to be made in order to accommodate these variations. However, due to the variety of shapes the transmissions are often mounted off center to the jack with respect to either the lateral or longitudinal relation of the transmission to the jack. This imparts a side load to the lifting mechanism of the jack which causes binding on the piston assemblies used to raise and lower the load and reduces the overall stability of the jack.

SUMMARY OF THE PRESENT INVENTION

The present invention relates to an adaptor which can be readily attached to the platform on a transmission jack. The adaptor is adjustable in both the longitudinal and lateral directions of the transmission to provide accurate centering of a various transmission on the platform of the jack.

In the regard, the adaptor includes a centering block which is secured to the tilt platform. A pair of plate assemblies are mounted on the platform for simultaneous movement toward and away from the centering block. A pair of fixtures are mounted on each of the assemblies and are selectively movable laterally with respect to the movement of the plate assemblies. The fixtures are used to align the longitudinal axis of the transmission with the jack. The plates are used to vary distance between the fixtures to both stabilize the transmission on the jack as well as aligning the fixtures with the transmission.

One of the primary features of the invention is the ability to interchange various fixtures on the adaptor for centering the longitudinal axis of the transmission on the jack. The fixtures are adjustable to both accommodate various sizes of transmissions as well as interchangeable to accommodate various transmission configurations.

A particularly important feature is the ability to simultaneously move the fixtures longitudinally with respect to the axis of the transmission in order to stabilize the transmission on the jack.

Other principal features and advantages of the invention will become apparent to those skilled in the art upon review of the following drawings, the detailed description and the appended claims.

DETAILED DESCRIPTION OF THE DRAWINGS

Figure 1:
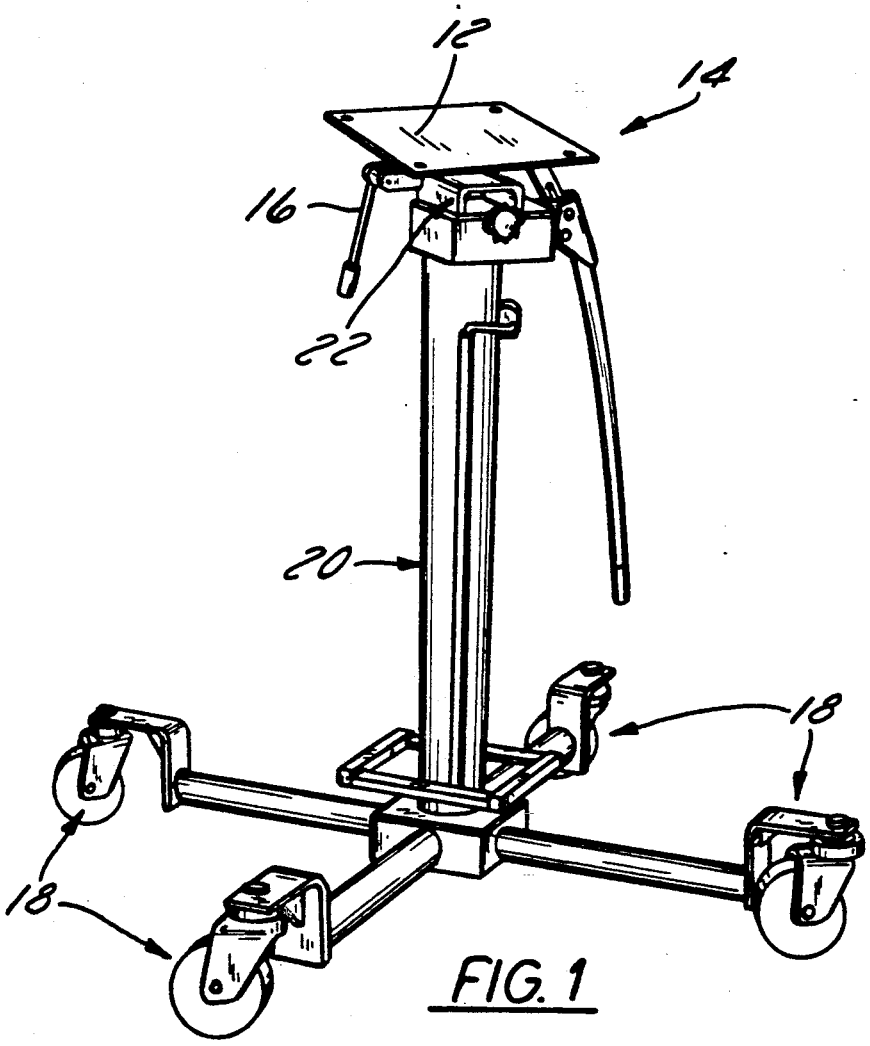
FIG. 1 is a perspective view of a transmission jack showing the tilt platform on the top of the jack.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The adaptor 10 according to the present invention as shown in FIGS. 2 through 6 is mounted on the tilt platform 12 on the top of a jack 14 as shown in FIG. 1. The platform 12 is provided with adjustment screws 16 for tilting the platform to align a transmission with the underbody of a vehicle. The jack 14 is of a conventional type having a pneumatic piston cylinder assembly 20 for elevating the platform 12 and a hydraulic piston and cylinder assembly 22 for final vertical positioning of the platform 12. Roller assemblies 18 are provided at the bottom of the jack for transporting the transmission.

The adaptor 10 generally includes a centering block 24 which is secured to the platform 12 by screws 26. An outer plate assembly 32 is provided on one side of the centering block 24 and an inner plate assembly 34 is provided on the opposite side of the centering block 24. Each of the plate assemblies includes a pair of fixture assemblies 36 for centering the longitudinal axis of the transmission on the platform 12. Means are provided for simultaneously moving the plate assemblies 32 and 34 longitudinally with respect to the transmission to accommodate the various lengths of the transmission.

In this regard the centering block 24 includes a bore 28 which is generally aligned with the longitudinal axis of the transmission. A groove 30 is provided at the bottom of each end of the centering block 24 to form a guide surface for the inner plate assembly 34. The inner plate assembly 34 includes a spacer plate 25 on the bottom which is used to support the portion of the inner plate assembly 34 which is not supported by the outer plate assembly 32.

The outer plate assembly 32 includes a plate 38 having a C-shaped flange 40 on each side and a slot 42 in one end of the plate 38 which is aligned with the centering block 24. The plate 38 is mounted for sliding movement on the platform 12 and is aligned with the edges of the platform 12 by means of angle irons 44 welded to the outer sides of the flanges 40. The angle irons 44 define a space 46 with the bottom of the plate 38 to enclose the edges of the platform 12. A fixture support bar 48 is mounted on the outer end of plate 38. An adjustment block 50 having a threaded opening 64 is mounted on the top of the plate 38 at the end of the slot 42.

The inner plate assembly 34 includes a plate 35 having a C-shaped flange 52 on each side and a slot 54 in one end of the plate 35. The C-shaped flanges 52 are aligned with the inside of the C-shaped flanges 40 on the outer plate 38 with the slot 54 aligned with the sides of the groove 30. It should be noted that the grooves 30 are greater in depth than the thickness of the plate 35 to provide clearance for the plate 38. The spacer plate 25 also provides a space between the inner plate 35 and the platform 12 for the outer plate 38. A fixture support bar 48 is mounted on the outer edge of the inner plate 35. An adjustment block 60 having a threaded opening 66 is mounted on the inner plate at the end of the slot 54.

The plate assemblies 32 and 34 are simultaneously moved toward and away from the centering block 24 by means of a double threaded rod 62 which is aligned with the bore 28 in the centering block and the threaded openings 64 and 66 in the adjustment blocks 50 and 60, respectively. A stop ring washer 65 is mounted on the rod 62 on each side of the centering block 24 to prevent axial movement of the rod 62 with respect to the block 24. The rod 62 projects through an opening 68 in each of the support bars 48. A crank 70 is mounted on the end of the rod 62 for rotating the rod to adjust the positions of the inner and outer plate assemblies 32 and 34. Each of the support bars 48 includes a number of teeth 45 forming notches 47 along the bottom of each support bar 48.

Figure 2:
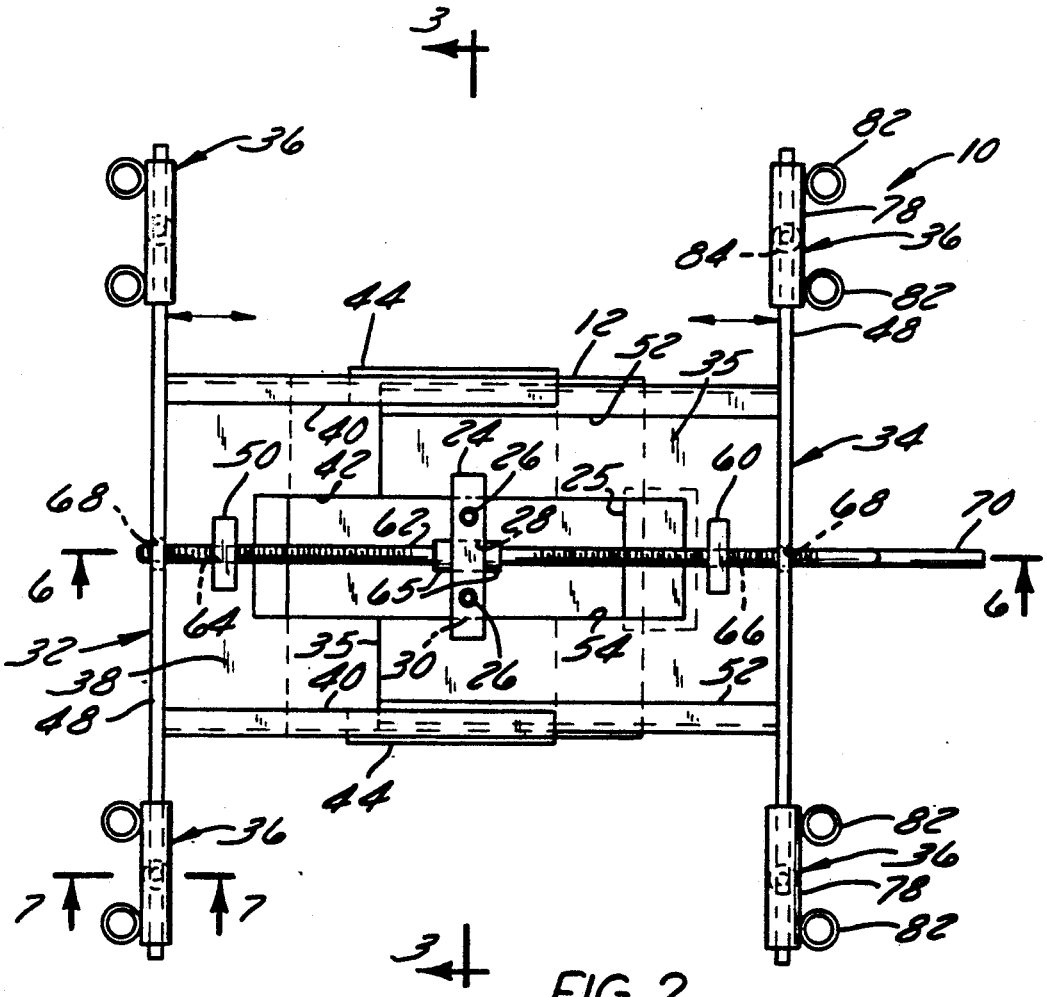
FIG. 2 is a top plan view on the adaptor according to the invention.
Figure 6:
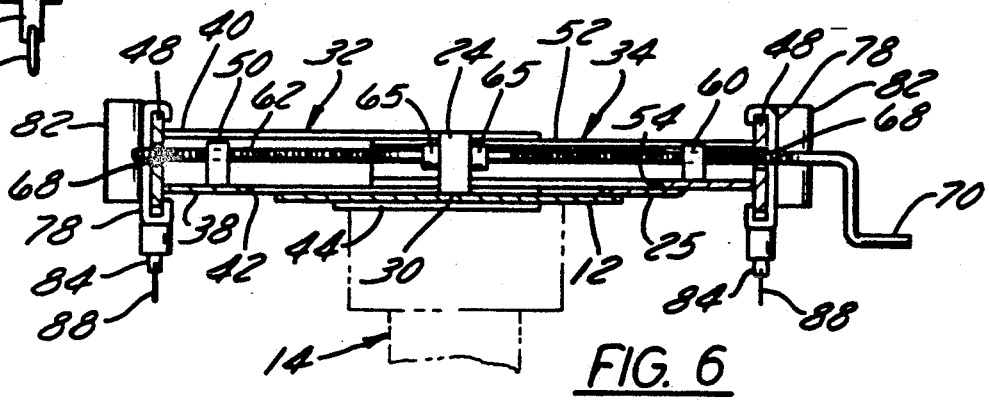
FIG. 6 is a side view taken on line 6—6 of FIG. 2.
Figure 5:
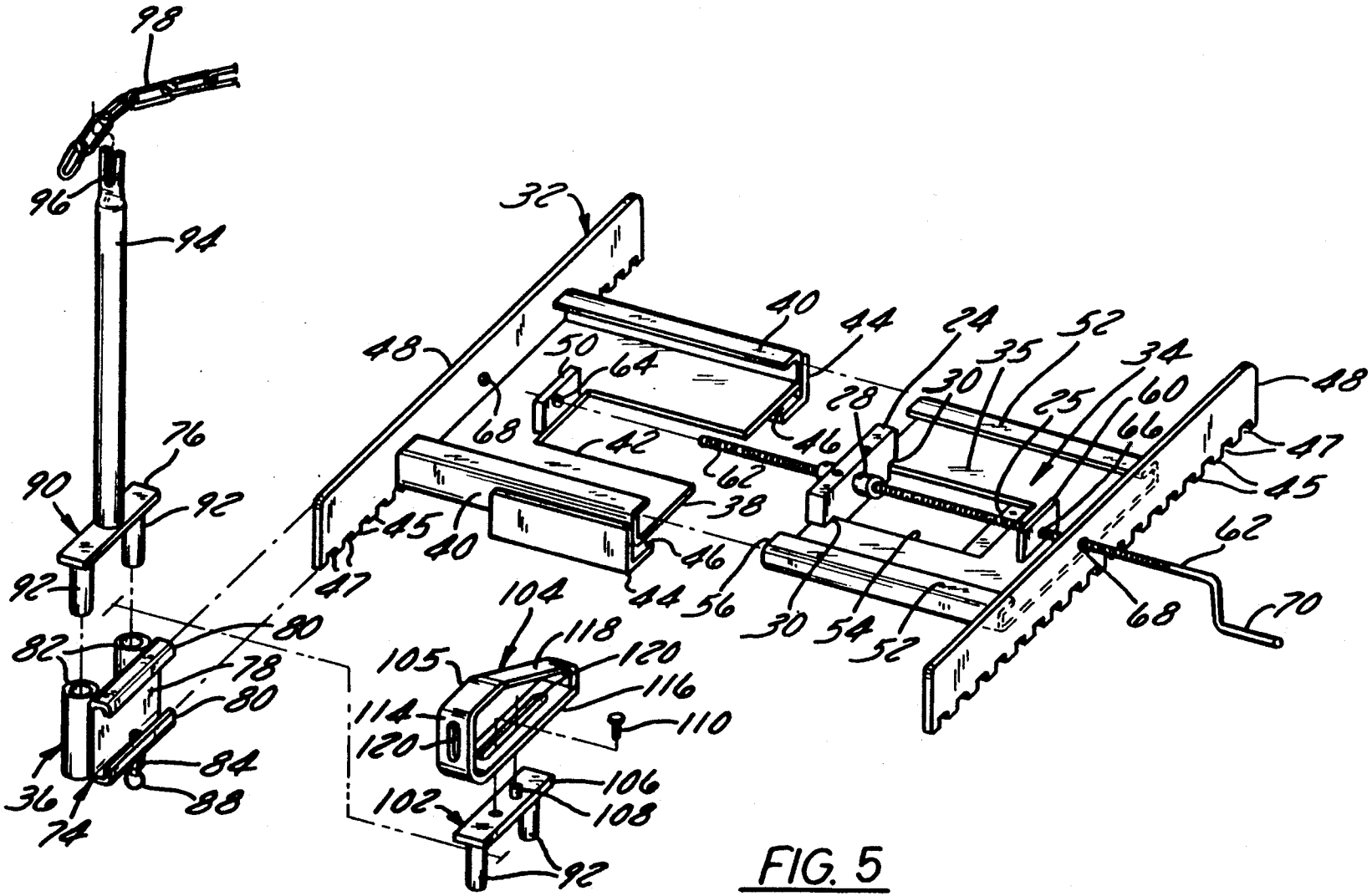
FIG. 5 is an exploded perspective view of the adaptor.

Referring to FIGS. 2, 5 and 6 a fixture assembly 36 is shown mounted on each end of each support bar 48. Each fixture assembly 36 includes a mounting bracket 74 and a fixture 76. Each mounting bracket 74 includes a plate 78 having a C-shaped flange 80 at the top and bottom and a pair of hollow tubes 82 mounted on the outside of the plate 78. The mounting brackets 74 can be mounted on the support bars 48 with the tubes 82 on either the inside or outside of the bar 48. A spring biased pin 84 is provided in the bottom C-shaped flange 80 which is located in a position to engage the notches 47 between the teeth 45 on the bottom of each of the support bars 48. The pin 84 is bias a spring 86 into engagement with the notches 47. A pull ring 88 is provided on the end of the pin 84 to pull the pin downward out of engagement with the notches 47 when the mounting bracket 74 is to be moved to a different location on the adjustment bar.

The fixture 76 is one of a number of fixtures which can be interchangeably mounted on the brackets 74. The fixture 76, as shown in FIGS. 4 and 5, includes a plate 90 having a pair of pins 92 mounted on the bottom in a position to be inserted into the hollow tubes 82 provided on the mounting bracket 74. As shown in the drawing a fixture assembly 36 is mounted on each end of the adjustment bars 48 thus providing four support points on the adaptor. The fixture 76 is used to support a chain 98 and includes a support rod 94 having a slot 96 at the upper end. One link of the chain 98 is aligned in the slot 96 on each end of each support bar 48 to provide a sling for supporting a transmission. With this arrangement the mounting brackets 74 can be moved inwardly or outwardly to align the rods 94 with the outer configuration transmission and thereby align the longitudinal axis of the transmission the center of the platform 12. A retainer chain 75 is connected to the fixture assembly 36 and extended over the top of the transmission to retain the transmission in the align as shown in FIGS. 3 and 4.

Figure 3:
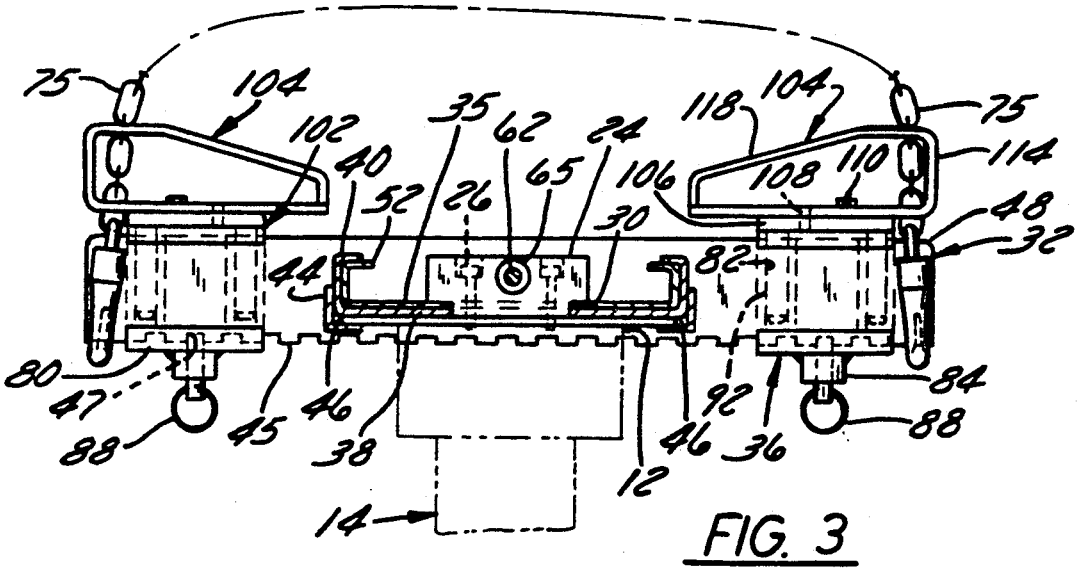
FIG. 3 is a cross section view of the adaptor taken on line 3—3 of FIG. 2.
Figure 4:
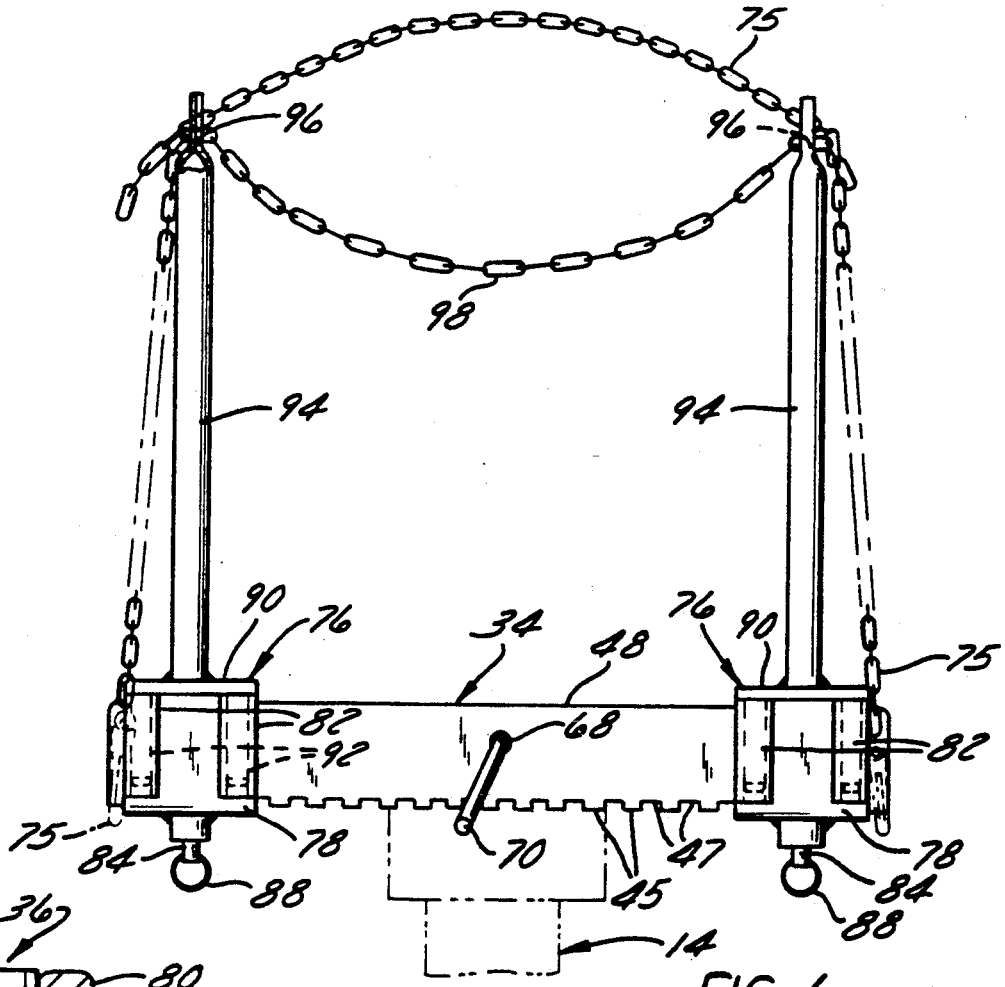
FIG. 4 is an end view of the adaptor.
Figure 7:
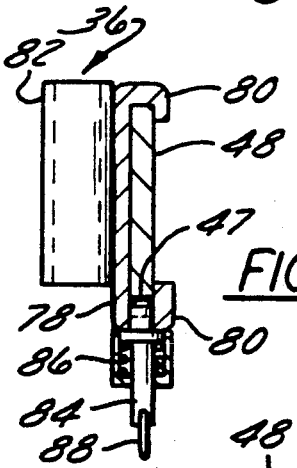
FIG. 7 is a cross sectional view taken on line 7—7 of FIG. 2.

An alternate form of fixture assembly 36 is shown in FIGS. 3 and 5, which provides a cradle type support for a transmission. The fixture assembly 36 includes the same mounting bracket 74 as described above and a support bracket 102 for supporting a cradle forming fixture 104. The support bracket 102 includes a plate 106 having a pair of pins 92 positioned for insertion into hollow tubes 82. A centering pin 108 and a threaded pin 110 are provided on the top of the plate 106. The cradle fixture 104 is secured to the plate 106 by the threaded pin 110.

The cradle fixture 104 includes a frame 105 having a short leg 114 connected to a long leg 116 at a right angle with the other ends of the legs connected by an angularly offset section 118 which in combination with the outer fixture on the support bar 48 forms a cradle for supporting a transmission. Each of the legs includes a slot 120. The frame 105 is mounted on the support bracket by aligning one of the slots with the pin 108. The bolt 110 aligned with slot 120 and screwed into a threaded hole in the plate 106. It should be noted that the cradle support can be mounted horizontally, as shown in FIG. 3, to provide a wide cradle or vertically, to provide a narrow cradle.

Thus, it should be apparent that there has been provided in accordance with the present invention a load carrying adaptor for a transmission jack that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An adaptor for a transmission jack of the type having an adjustable platform on the upper end of the jack for supporting a transmission, said adaptor comprising a centering block mounted on the platform, an outer plate assembly mounted on the platform and having a centering slot in one end aligned with one side of said centering block on the platform, an inner plate assembly having a centering slot in one end mounted for reciprocal movement in said outer plate assembly with the slot aligned with the centering block, said centering block including a groove on the bottom of each side, said slot in said inner plate assembly being aligned with said grooves to maintain said inner plate assembly in alignment with said centering block, a support bar mounted on the other end of each of the inner and outer plate assemblies, a pair of fixture assemblies mounted on each of said support bars, each fixture assembly including means for supporting the transmission and means operatively connected to each of said inner and outer plate assemblies for moving the inner and outer plate assemblies simultaneously toward and away from said centering block to increase or decrease the distance between said support bars to accommodate the length of the transmission.

2. The adaptor according to claim 1 including a spacer block on the bottom of said inner plate assembly to maintain said inner plate assembly level with respect to the platform.

3. The adaptor according to claim 2 wherein said fixture assemblies each includes a mounting bracket mounted on each end of each support bar and a fixture mounted on said bracket.

4. The adaptor according to claim 3 wherein said mounting bracket includes a plate having a C-shaped flange on the top and bottom of said plate and a pair of hollow tubes mounted in a parallel spaced relation on the outside of the plate and said fixture includes a plate having a pair of pins mounted in a parallel spaced relation on the bottom of said plate for mating engagement with said tubes.

5. The adaptor according to claim 4 wherein each of said fixtures includes a post on said plate for supporting one end of a chain to form a sling for supporting the transmission.

6. The adaptor according to claim 4 wherein each of said fixtures includes a frame having an angularly offset surface mounted on said bracket to form a cradle for the transmission.

7. The adaptor according to claim 4 wherein said support bars include a series of notches and said mounting brackets includes means for selectively engaging said notches to lock said bracket to said bar.

* * * * *